United States Patent [19]

Pfeifer

[11] Patent Number: 4,768,661

[45] Date of Patent: Sep. 6, 1988

[54] BINNING AND BANDING STRUCTURE AND CLIPS THEREFOR

[75] Inventor: William Pfeifer, Springdale, Pa.

[73] Assignee: Armstrong Store Fixture Corporation, Pittsburgh, Pa.

[21] Appl. No.: 800,338

[22] Filed: Nov. 21, 1985

[51] Int. Cl.[4] ..... A47F 5/10

[52] U.S. Cl. ..... 211/184; 312/140.4

[58] Field of Search ..... 211/184, 43, 10, 11, 211/40, 41; 312/140, 140.3, 140.4; 403/205, 217; 108/60, 61; 312/263

[56] References Cited

U.S. PATENT DOCUMENTS

| | | | |
|---|---|---|---|
| 1,940,505 | 12/1933 | Paulick | 312/140 |
| 1,961,486 | 6/1934 | Hall | 312/140 |
| 1,962,967 | 6/1934 | Nathan | 211/184 |
| 2,220,469 | 11/1940 | Wouters | 211/184 |
| 2,228,221 | 1/1941 | Bales | 312/140.3 |
| 2,885,091 | 5/1959 | Van Pelt | 211/184 |
| 2,894,303 | 7/1959 | Armstrong et al. | 24/81 |
| 3,027,213 | 3/1962 | Weber | 312/140.3 |
| 3,501,019 | 3/1970 | Armstrong et al. | 211/184 |
| 3,872,976 | 3/1975 | Moore et al. | 211/184 |
| 4,191,439 | 3/1980 | Cohen | 312/263 X |
| 4,935,955 | 8/1983 | Pfeifer | 108/61 |

*Primary Examiner*—Carl D. Friedman

*Attorney, Agent, or Firm*—Parmelee, Miller, Welsh & Kratz

[57] ABSTRACT

A binning and banding structure, binning partition and novel clips to secure binning and banding partitions to each other. The clips include a first U-shaped clamp having arms capable of gripping the vertical edge of a binning partition and a second U-shaped clamp integral with the first U-shaped clamp capable of sliding into engagement with the top edge of the banding partition. The arms on the first U-shaped clamp include means engageable with means on the binning partition for limited sliding vertical movement of the clip on the binning partition and for inhibiting horizontal longitudinal movement of the clip on the binning partition.

46 Claims, 6 Drawing Sheets

BINNING AND BANDING STRUCTURE AND CLIPS THEREFOR

FIELD OF THE INVENTION

This invention relates to a binning and banding structure used to separate merchandise on display shelves, to a binning partition and to novel clips used to secure binning and banding partitions to each other and in an upright position on the shelves.

BACKGROUND OF THE INVENTION

In dividing shelf area for displaying merchandise the partitions adjacent the edges of the shelves are commonly referred to as banding, while the partitions which form the interior dividers are referred to as binning. These partitions have been secured to each other by means of separate clips, such as in U.S. Pat. Nos. 1,961,486 to Hall, 2,220,469 to Wouters, 2,885,091 to Van Pelt, and 2,894,303 to Armstrong et al. These partitions have also been secured to each other by means of clips anchored to a shelf, such as in U.S. Pat. Nos. 1,940,505 to Paulick, 1,961,486 to Hall, referred to above, and 2,228,221 to Bales. In U.S. Pat. No. 1,962,967 to Nathan, these partitions have been secured to each other by means of a clip anchored to one of the partitions. Armstrong et al. in U.S. Pat. No. 3,501,019, secure a partition to a shelf by means of hooks integral with the partition, while in U.S. Pat. Nos. 3,872,976 to Moore et al. and 4,395,955 to Pfeifer, partitions are secured to each other and to a shelf by means integral with the partitions.

All of the arrangements defined by the above patentees seek to satisfy similar objectives, that is, to secure the partitions to each other and/or to a shelf. A principal objective, however, is flexibility, not only in adapting the partitions to a number of different configurations but also in the standardization of components. Another important objective is ease of use in obtaining the desired configurations. The partitions must be capable of being rearranged quickly and easily, even by unskilled personnel. Additionally, the partitions must be durable to withstand hard use and stable to resist disengagement of the partitions with each other and with the shelf on which they rest.

SUMMARY OF THE INVENTION

The novel binning and banding structure defined and claimed herein includes at least one banding partition and at least one binning partition securely connected at a vertical edge thereof at right angles to the banding partition by means of a novel unitary clip. The clip comprises a first U-shaped clamp having spaced, substantially parallel, outwardly extending arms that grip the vertical edge of the binning partition adjacent the banding partition and that is vertically slidable on the binning partition. The clip also comprises a second U-shaped clamp integral with the first U-shaped clamp slidable into engagement with the adjacent top edge of the banding partition. Included are first engagement means on at least one of the arms of the first U-shaped clip engageable with second engagement means on the binning partition capable of cooperating therewith for limited sliding vertical movement of the clip on the vertical edge of the binning partition and for inhibiting horizontal longitudinal movement of the clip on the binning partition. In one embodiment, each of the arms on the first U-shaped clamp is provided with facing projections, such as flanges, or pins, capable of riding within vertically extending channels in the adjacent faces of the binning partition. In a further embodiment, each of the arms on the first U-shaped clamp is provided with facing shoulders that form a vertical groove in which a cooperating laterally extending flange integral with and extending along the vertical edge of the binning partition can ride. In this embodiment, the top edge of the binning partition above the laterally extending flange is provided with abutment means for limiting vertical sliding movement of the clip. In still another embodiment, the arms on the first U-shaped clamp are provided with aligned, vertical, elongated slots through which a laterally extending projection, such as a flange or a pin, on the adjacent faces of the binning partition can extend. In yet another embodiment, one of the arms on the first U-shaped clamp is provided with an inward, laterally extending projection, such as a flange or a pin, capable of extending into a vertically extending slot in the adjacent face of the binning partition. In a further embodiment, the binning partition is provided with at least one lip projecting longitudinally outward from the lower edge thereof to engage the lower edge of a banding partition. Preferably, the binning and banding partitions are mounted on a shelf provided with apertures and the binning partitions are provided with at least one hook projecting downwardly from their lower horizontal edge which engages one of the apertures to secure the binning to the shelf. To facilitate engagement of said at least one hook with the apertures in the shelf, the binning is preferably provided with a vertical elongated slot adjacent one of its vertical edges. In this way, the portion of the binning partition between the latter elongated slot and the adjacent vertical edge of the binning partition can flex longitudinally, and alignment of the hook with the apertures in the shelf will be facilitated.

DESCRIPTION OF THE PREFERRED EMBODIMENTS

Figure 1:
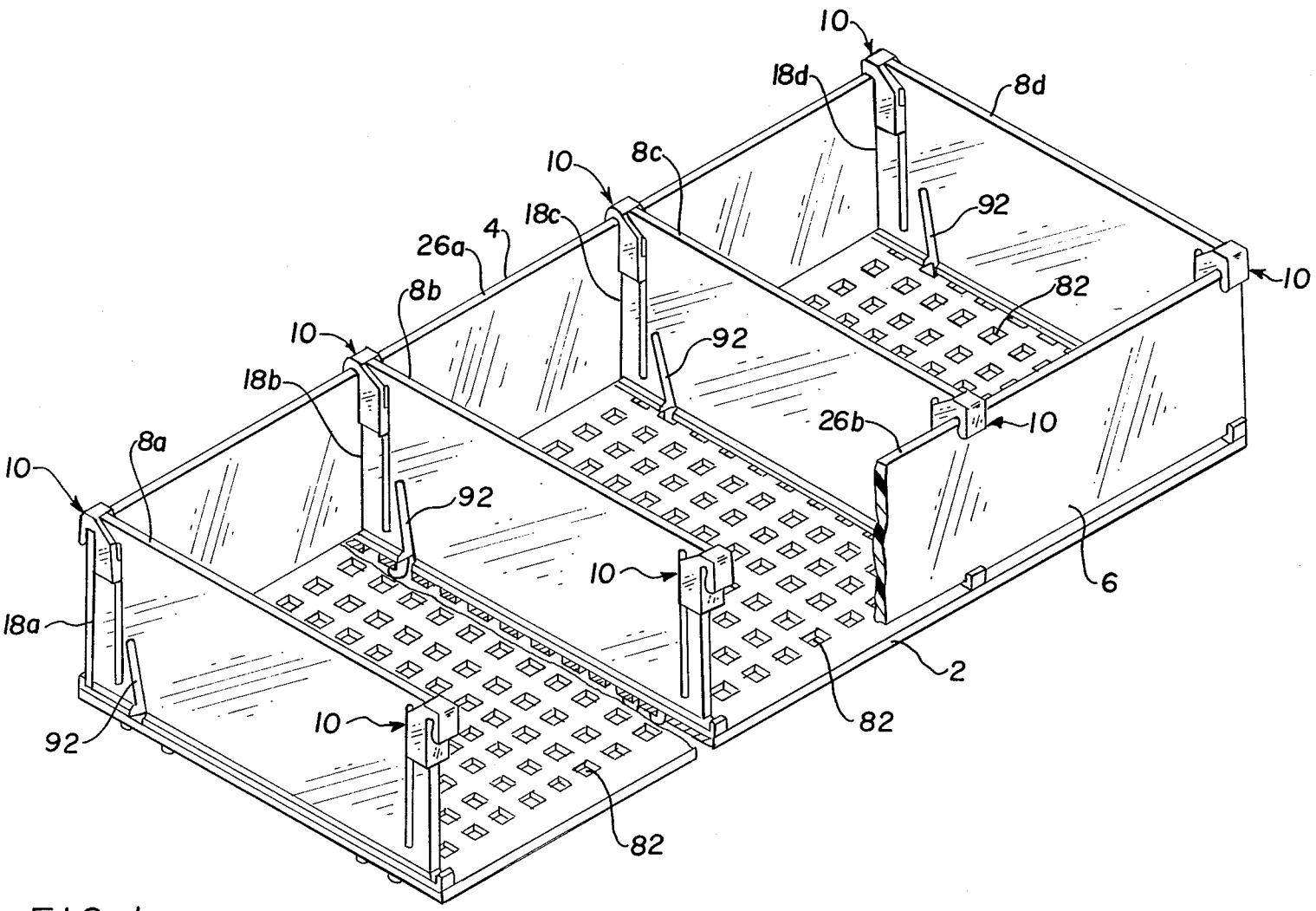
FIG. 1 is a perspective view, with some portions cut away, of a novel binning and banding assembly or arrangement defined and claimed herein.
Figure 2:
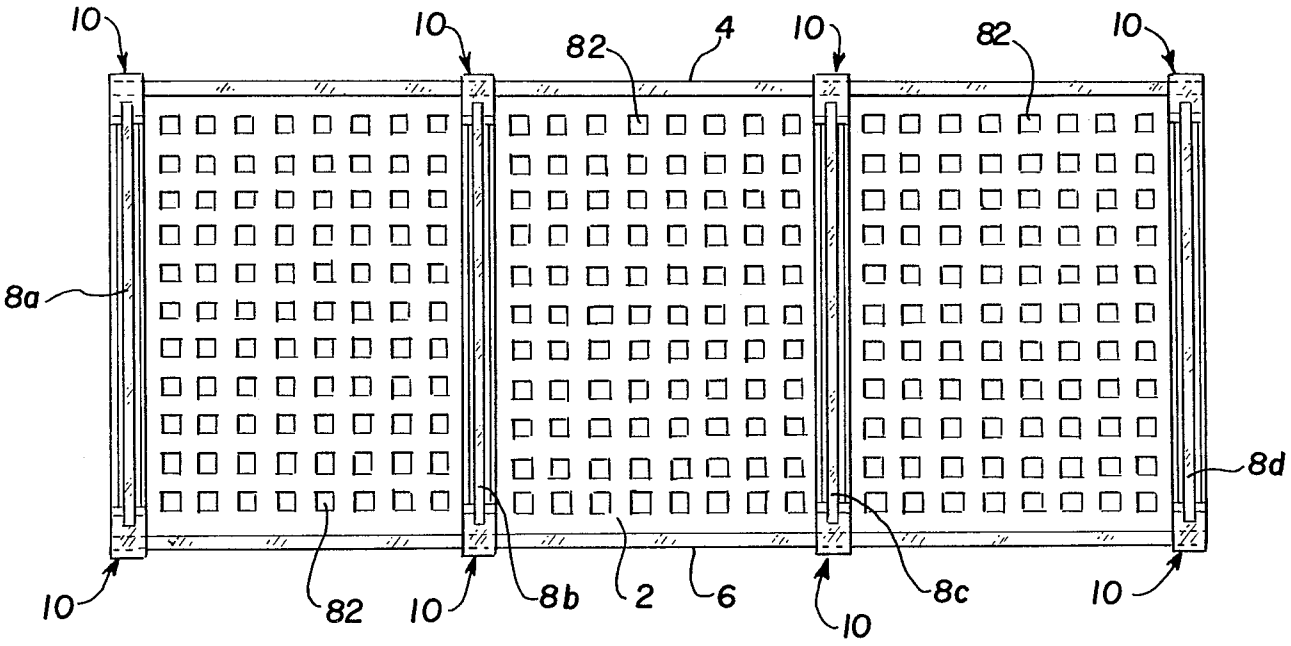
FIG. 2 is a plan view of the novel binning and banding assembly of FIG. 1.
Figure 3:
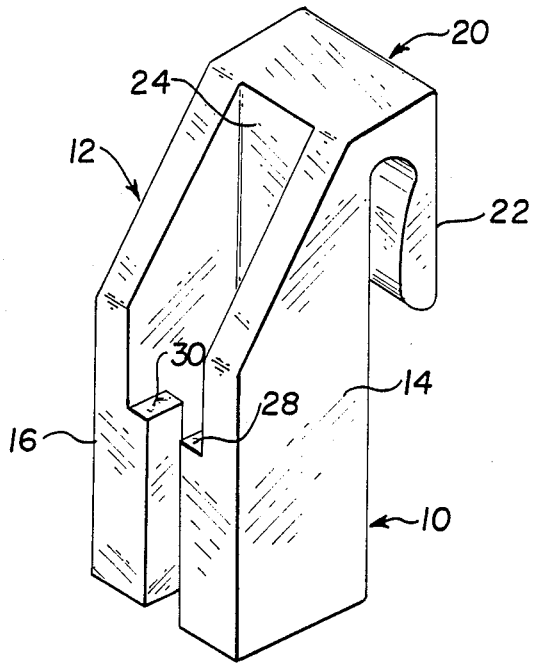
FIG. 3 is a perspective view of one novel clip defined and claimed herein.

Referring to FIGS. 1 and 2, there is shown a shelf 2 provided with an elongated banding partition 4 along the rear end thereof, an elongated banding partition 6 along the front edge thereof and four binning or divider partitions 8*a*–8*d*, which extend across the width of the shelf at spaced intervals. The binning and banding partitions are securely connected at right angles to each other using one or more of the novel clips defined hereinafter. In FIGS. 1 and 2, clip 10 is used, described hereinafter, and the arrangement of the binning and banding partitions shown is illustrative only, with numerous other arrangements possible.

Each of the clips illustrated in FIGS. 3 to 7 is a unitary clip, having a first engagement means, capable of securely connecting an elongated binning partition, having a second engagement means, at a vertical edge thereof at right angles to an elongated banding partition. The clips comprise a first U-shaped clamp 12 having spaced, substantially parallel, outwardly extending arms 14 and 16 capable of gripping a vertical edge 18*a*–18*d* (FIG. 1) of a binning partition 8*a*–8*d* adjacent a banding partition, between said arms 14 and 16. Each of the clips is also provided with a second U-shaped clamp 20 integral with said first U-shaped clamp 12 having spaced, substantially parallel, downwardly extending arms 22 and 24 capable of sliding into engagement with, and frictionally securing, the adjacent top edge 26*a* or 26*b* (FIG. 1) of banding partitions 4 or 6, respectively. Additionally, each of the clips is provided with first engagement means on arms 14 and 16 on the first U-shaped clamp 12 engageable with second engagement means on a binning partition on which it is mounted, for limited sliding vertical movement of the clip on the vertical edge of the binning partition and that will inhibit horizontal longitudinal movement of the clip on the binning partition.

As seen in FIGS. 1 through 3 and FIGS. 8 and 9, when clip 10 is used, the first engagement means for limiting vertical sliding movement and inhibiting horizontal, longitudinal movement thereof on a binning partitions 8*a*–8*d*, comprises inwardly extending facing projections, such as flanges, 28 and 30 integral with arms 14 and 16, respectively. The flanges 28 and 30 ride in second engagement means comprising vertical channels 32 and 34, respectively, in the outer faces 36 and 38, respectively, of binning partition 8. The channels 32 and 34 extend vertically, adjacent the edges of the binning partition 8 and terminate at a location spaced from the top and bottom thereof. While the channels 32 and 34 are illustrated as extending almost the full height of the binning partition 8, a shorter channel or series of spaced channels would also be usable.

In order to mount the clip 10 on the binning partition, one merely pulls apart the free ends of arms 14 and 16 and then pushes the clip onto the binning partition, over the edge thereof, until the flanges 28 and 30 of the clip engage the corresponding channels, either 32 or 34 on the binning partition. This engagement permits the clip to slide vertically thereon within the confines of the channels. To remove the clip from the binning partition, the procedure is merely reversed. After the clip is attached to the binning partition, the binning partition is attached at right angles to the banding partition by moving the clip vertically upwardly on the binning partition, placing the adjacent vertical edge of the binning partition at right angles to the banding partition, then moving the clip downwardly until engagement is made between the second U-shaped clamp 20 and the adjacent top edge of the banding partition.

The clip of the present invention, with limited vertical movement on the binning partition, enables the use of a single size binning partition 8 with a variety of different sizes of banding partitions 6, with the banding partition abutted against the edge of the binning partition and the vertically slidable clip forced over the top thereof to retain the banding partition in secure relationship to the binning partition.

Figure 4:
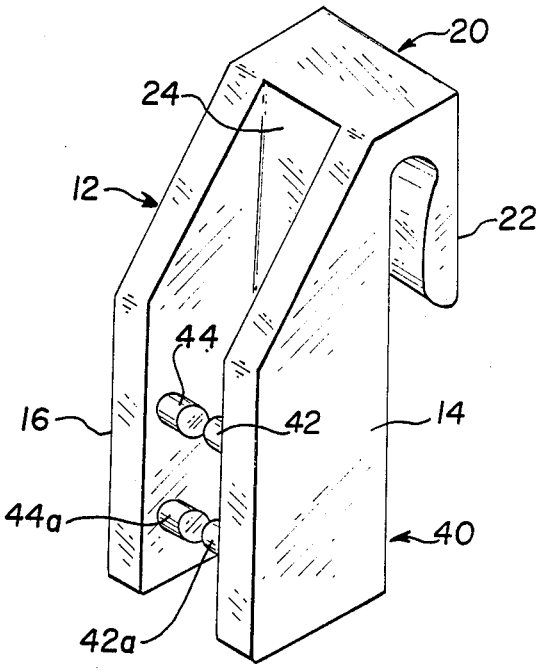
FIG. 4 is a perspective view of another embodiment of a novel clip defined and claimed herein.
Figure 9:
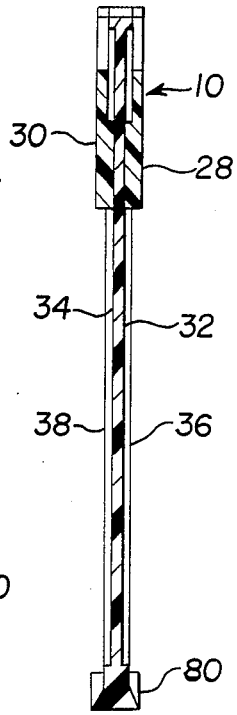
FIG. 9 is an enlarged cross-section along the line 9—9 of FIG. 8.
Figure 11:
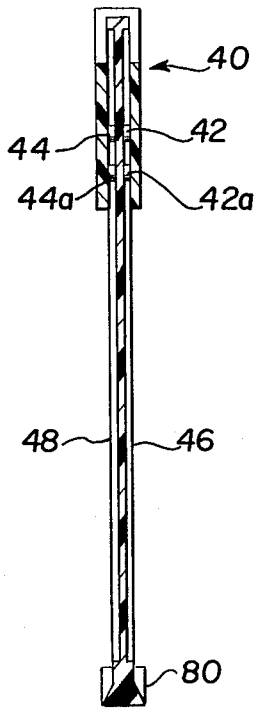
FIG. 11 is a cross-section along the line 11—11 of FIG. 10.
Figure 10:
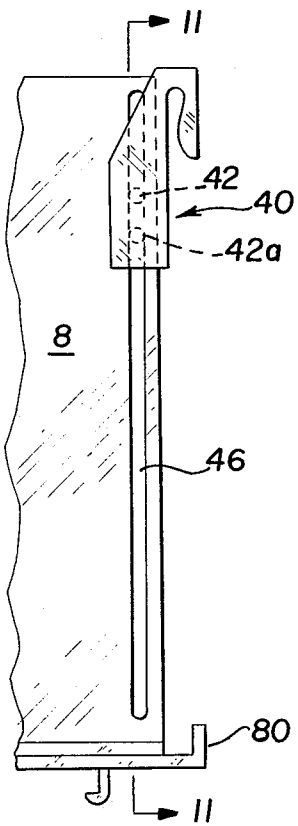
FIG. 10 is a view in elevation of a portion of a novel binning member carrying the novel clip of FIG. 4.

In the embodiment illustrated in FIG. 4, the clip 40 is provided with first engagement means comprising facing projections, such as pins, 42 and 44, rather than laterally extending flanges, which pins 42 and 44 engage with second engagement means, illustrated as channels 46 and 48, respectively (FIGS. 10 and 11), similar to vertical channels 32 and 34 illustrated in FIG. 9. If desired, the arms 14 and 16 can be provided with additional pins 42*a* and 44*a* vertically aligned with pins 42 and 44 respectively, for engagement with and slidable along vertical channels 46 and 48, in order to provide additional stability for the clip engagement and better inhibiting of the clip 40 against horizontal, longitudinal movement thereof on the binning partitions.

Figure 5:
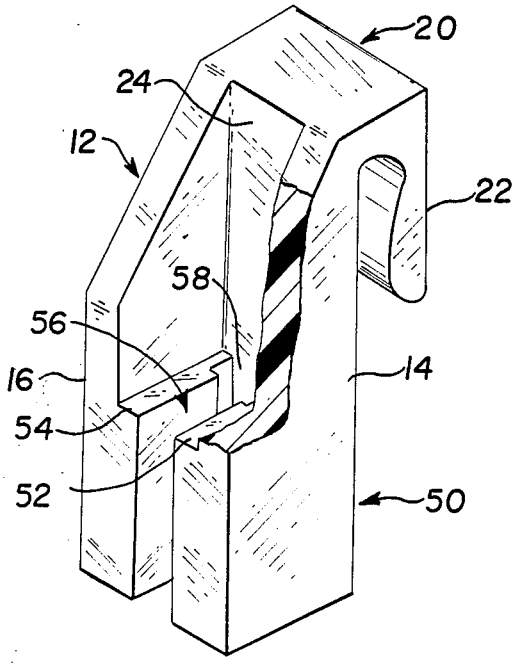
FIG. 5 is a perspective view, with some portions cut away, of still another embodiment of a novel clip defined and claimed herein.
Figure 13:
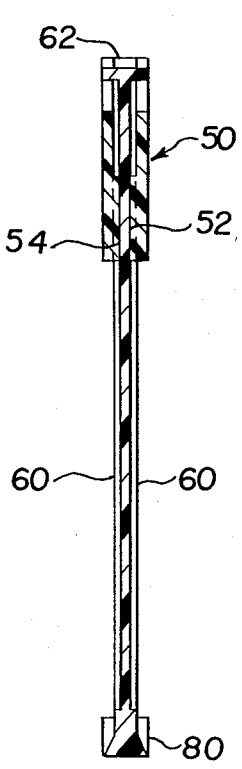
FIG. 13 is a cross-section along the line 13—13 of FIG. 12.
Figure 12:
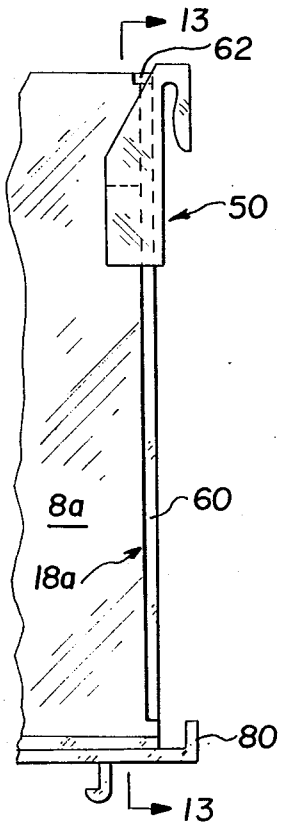
FIG. 12 is a view in elevation of a portion of a novel binning member carrying the novel clip of FIG. 5.

FIG. 5 illustrates another embodiment of a clip usable in the present binning and banding structure. The clip 50 has first engagement means thereon in the form of inwardly directed spaced facing shoulders 52 and 54 with an elongated slot 56 provided therebetween, in which the vertical edge 18*a* of binning partition 8*a* will slidably fit. The inner portion of the shoulders, adjacent arm 24, each have a vertical groove 58. The second engagement means on the binning partition 8 comprises a cooperating laterally extending flange 60 (FIGS. 12 and 13) integral with, and extending along, the vertical edge 18 of binning partition 8. The flange 60 will engage within the vertical groove 58, whereby the clip is vertically slidably movable along the edge 18 of the binning partition 8. In this embodiment, the top edge of the binning partition, above flange 60 is provided with abutment means, such as top flange 62, to limit vertical sliding movement of the clip 50 on the binning partition 8.

Figure 6:
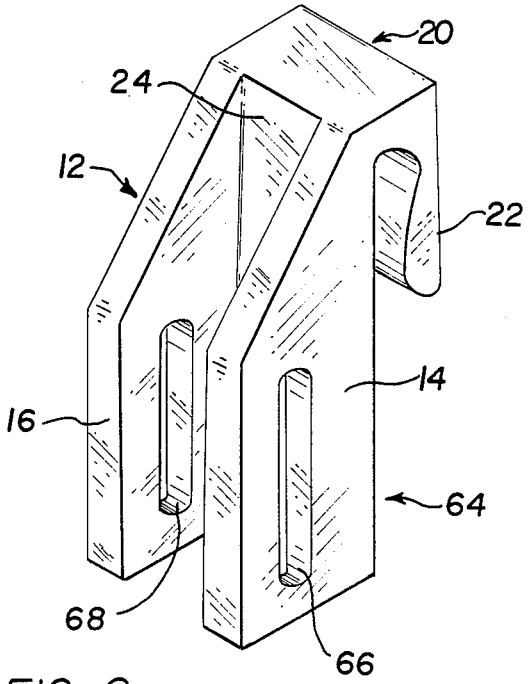
FIG. 6 is a perspective view of yet another embodiment of a novel clip defined and claimed herein.
Figure 15:
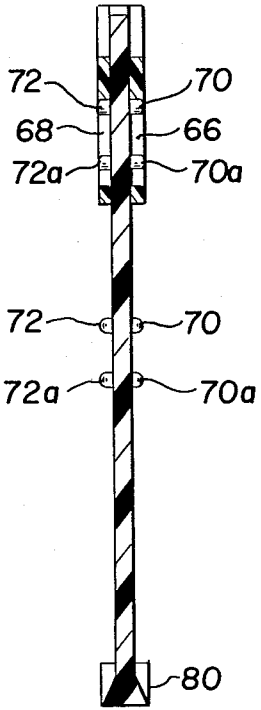
FIG. 15 is a cross-section along the line 15—15 of FIG. 14.
Figure 14:
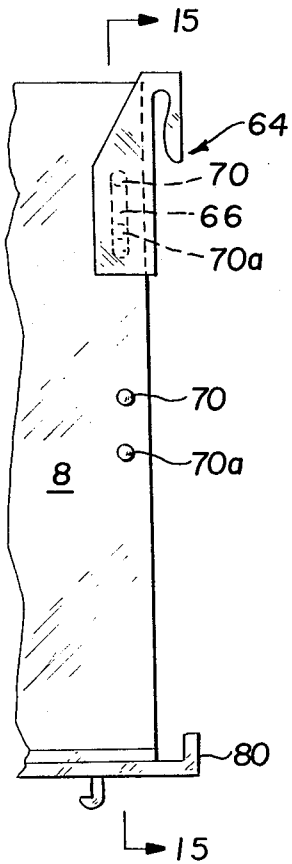
FIG. 14 is a view in elevation, of a portion of a novel binning member carrying the novel clip of FIG. 6.

In a further embodiment of the clip, clip 64, of the present invention, illustrated in FIG. 6, the first engagement means on arms 14 and 16 comprises aligned vertically elongated slots 66 and 68, respectively. The second engagement means on the binning partition (FIGS. 14 and 15) comprise laterally extending projections on the binning partition 8, such as pins 70 and 72, respectively. If desired, the binning partition 8 can be provided with additional pins 70*a* and 72*a* vertically aligned with pins 70 and 72, respectively for additional stability. The pins on the binning partition extend into slots 66 and 68 and limit vertical sliding movement of the clip along the edge of the binning partition.

Figure 7:
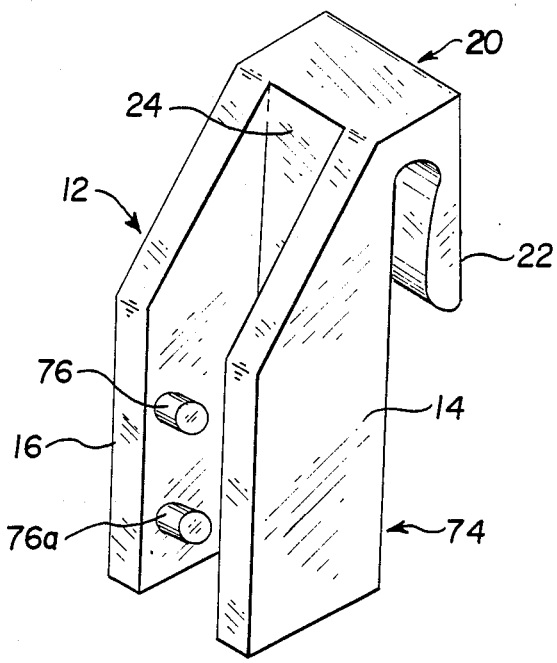
FIG. 7 is a perspective view of a further embodiment of a novel clip defined and claimed herein.
Figure 17:
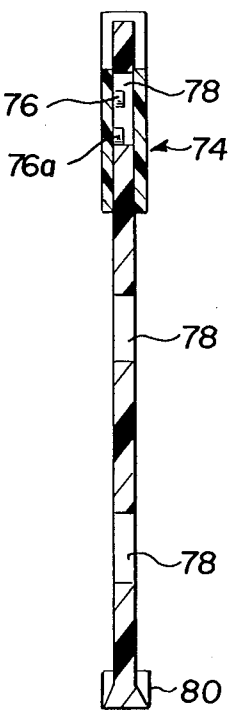
FIG. 17 is a cross-section along the line 17—17 of FIG. 16.
Figure 16:
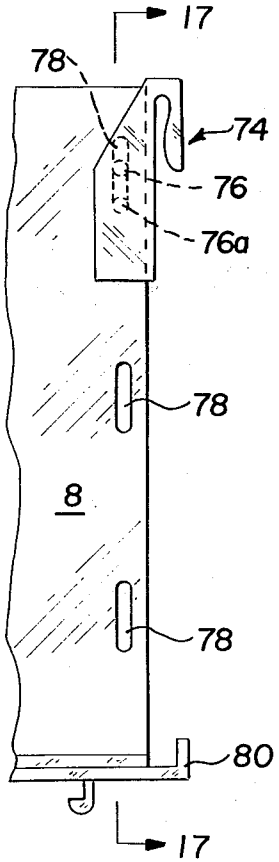
FIG. 16 is a view in elevation, of a portion of a novel binning member carrying the novel clip of FIG. 7.

Another embodiment of the clip, clip 74, is illustrated in FIG. 7, and has a projection, such as a pin, 76 on at least one of the arms 14 and 16 of the first U-shaped clamp, as the first engagement means, and the binning partition 8 has vertically extending slots 78 (FIGS. 16 and 17) therethrough into which the pin will fit, the slots 78 being adjacent the vertical edge of the binning partition. If desired, clip 74 can be provided with an additional pin 76*a* vertically aligned with pin 70, also capable of extending into slot 78.

Figure 8:
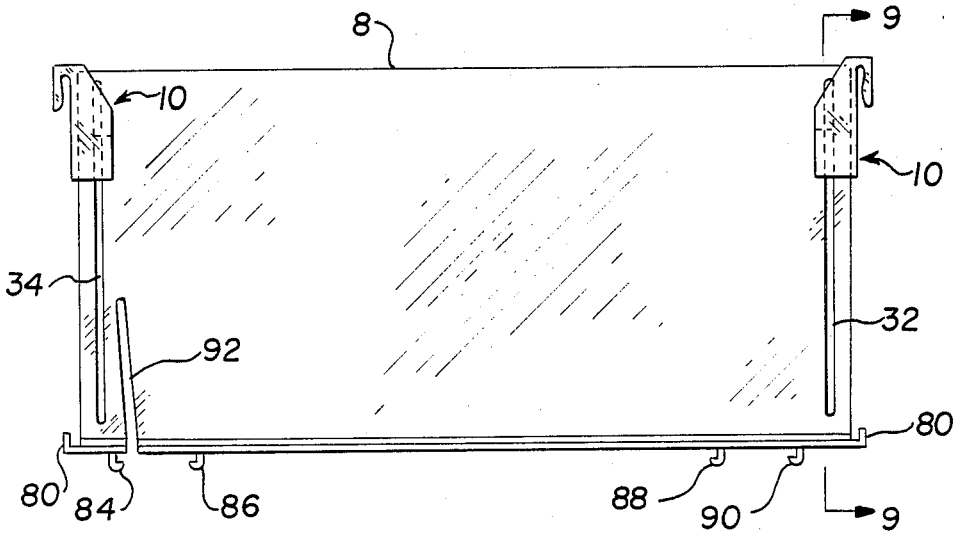
FIG. 8 is a view in elevation of a novel binning member or partition carrying the novel clip of FIG. 3.

As shown in FIG. 8, a binning partition 8 is preferably provided with at least one lip 80 projecting longitudinally outward from the lower edge thereof with the outer portion of the lip extending upwardly, to engage the lower horizontal edge of a banding partition 4, and to provide a support therefor.

The present binning and banding structure is also provided with means for securing the binning partitions 8 to a shelf, such as a shelf with a plurality of spaced apertures.

As shown in FIGS. 1 and 2, shelf 2 is provided with a plurality of apertures 82 and the lower horizontal edge of binning partition 8 is provided with at least one hook 84, preferably a plurality of hooks 84, 86, 88, 90, etc. (FIG. 8), having an open jaw to facilitate mounting binning partition 8 on shelf 2. Adjacent one of its vertical edges, binning partition 8 is preferably provided with an elongated vertical slot 92. In the preferred embodiment, the open jaw of each of the hooks faces slot 92. To mount a binning partition on shelf 2 in the preferred embodiment, hook 84 is inserted in an appropriate aperture 82. Since the binning partition is made of a flexible material, such as a polycarbonate resin, or other suitable plastic material, and the binning partition has been provided with the vertical slot 92, it is possible to then move the binning partition longitudinally away from the point of anchorage of hook 84 in its respective aperture 82, until the remaining hooks fall firmly within an adjacent aperture 82. When tension is then removed, binning partition will be held firmly in place by the oppositely faced hooks on both sides of slot 92.

The novel clip defined and claimed herein, together with the novel binning partition, thus permits securing binning and banding partitions to each other and to a shelf quickly and effectively. Yet the resultant arrangement is stable and resistant to disengagement of the partition from each other and from a shelf on which it may have been placed. The partitions can be attached to each other and to a shelf even by unskilled personnel.

What is claimed is:

1. A binning and banding structure comprising at least one banding partition and at least one binning partition having a vertical edge securely connected at one end at right angles to said banding partition by means of a unitary clip; said clip comprising a first U-shaped clamp having spaced, substantially parallel arms for gripping therebetween the vertical edge of said binning partition adjacent the banding partition, and a second U-shaped clamp integral with said first U-shaped clamp slidable into engagement with an adjacent top edge of said banding partition; first means on the arms of said first U-shaped clamp for engaging said binning partition; and second means on said binning partition for engagement with said first means, whereby limited upward and downward vertical sliding movement of said clip on said vertical edge of the binning partition is provided, after engagement of the first engaging means on the arms of said first U-shaped clamp with the second engaging means on said binning partition, and horizontal longitudinal movement of said clip on said binning partition is inhibited.

2. The binning and banding structure as defined in claim 1 wherein said first engagement means comprises at least one inwardly directed projection on at least one of said arms and said second engagement means comprises at least one vertically extending channel adjacent the vertical edge of said binning partition.

3. The binning and banding structure as defined in claim 2 wherein said first engagement means comprises at least one inwardly directed projection on each of said arms and said second engagement means comprises a pair of opposed vertical channels adjacent the vertical edge of said binning partition.

4. The binning and banding structure as defined in claim 3 wherein said at least one inwardly directed projections on each of said arms are in facing relationship relative to each other.

5. The binning and banding structure as defined in claim 1 wherein said first engagement means comprises inwardly directed, spaced, facing shoulders with an elongated slot therebetween in which the vertical edge of the binning partition slidably fits, with the inner portion of said shoulders defining a vertical groove, and said second engagement means comprises a cooperating laterally extending flange integral with, and extending along, the vertical edge of said binning partition engaging with said vertical groove, with the top edge of said binning partition above said flange having abutment means thereon to limit vertical sliding movement of said clip on said binning partition.

6. The binning and banding structure as defined in claim 1 wherein said first engagement means comprises at least one vertical slot on at least one of said arms and said second engagement means comprises at least one laterally extending projection on said binning partition extending into said vertical slot.

7. The binning and banding structure as defined in claim 6 wherein said first engagement means comprises a vertical slot on each of said arms and said second engagement means comprises at least one laterally extending projection on each of said arms of said binning partition extending into an adjacent said vertical slot.

8. The binning and banding structure as defined in claim 7 wherein said vertical slots are in vertical alignment with each other.

9. The binning and banding structure as defined in claim 1 wherein said first engagement means comprises at least one inwardly directed projection on at least one of said arms and said second engagement means comprises at least one vertically extending slot through said binning partition into which said at least one inwardly directed projection extends.

10. The binning and banding structure as defined in claim 9 wherein said first engagement means comprises a pair of vertically aligned inwardly directed projections, one of each of said pair on each of said arms.

11. The binning and banding structure as defined in claim 1 wherein a plurality of binning partitions are similarly attached at right angles to said banding partition.

12. The binning and banding structure as defined in claim 1 wherein the remaining end of said binning partition is similarly attached at right angles to a second banding partition.

13. The binning and banding structure as defined in claim 12 wherein said binning partition has a lip projecting longitudinally outward from both ends of the lower horizontal edge thereof to support the lower horizontal edge of each of said banding partitions thereon.

14. The binning and banding structure as defined in claim 1 wherein a plurality of binning partitions are similarly attached to said banding partition and the remaining end of at least one of said binning partitions is similarly attached at right angles to a second banding partition.

15. The binning and banding structure as defined in claim 1 wherein said binning partition has at least one lip projecting longitudinally outward from the lower horizontal edge thereof to support the lower horizontal edge of said banding partition.

16. The binning and banding structure as defined in claim 1 including a shelf having a plurality of apertures on a horizontal surface thereof, on which said binning and banding structure is disposed, and wherein the binning partition has at least one hook projecting downwardly from its lower horizontal edge into engagement with one of said apertures to secure said binning partition to said shelf.

17. The binning and banding structure as defined in claim 16 wherein said at least one hook has an open jaw and is disposed on one portion of said binning partition and at least one additional similar hook having an open jaw is similarly disposed on the remaining portion of said binning partition, with the open jaw of said at least one hook facing the open jaw of said at least one additional similar hook.

18. The binning and banding structure as defined in claim 17 wherein said binning partition has an elongated vertical slot intermediate said facing hooks, whereby said at least one hook can be inserted in one of said apertures on said shelf and said binning partition can then be moved longitudinally to facilitate insertion of said additional similar hook into another of said apertures on said shelf.

19. The binning and banding structure as defined in claim 1 wherein a plurality of binning partitions are similarly attached at right angles to said banding partition and the remaining ends of said binning partitions are similarly attached at right angles to a second banding partition, said binning partitions having a lip projecting longitudinally outward from the lower horizontal edge thereof, at both ends thereof, to support the lower horizontal edge of said banding partitions, including a shelf having a plurality of apertures on a horizontal surface thereof, said binning partitions having at least one hook projecting downwardly from their lower horizontal edge into engagement with one of said apertures to secure said binning partition to said shelf.

20. The binning ad banding structure as defined in claim 19 wherein said at least one hook has an open jaw and is disposed on one portion of said binning partitions and at least one additional similar hook having an open jaw is similarly disposed on the remaining portion of said binning partitions, with the open jaw of said at least one hook facing the open jaw of said at least one additional similar hook.

21. The binning and banding structure as defined in claim 20 wherein said binning partitions have an elongated vertical slot intermediate said facing hooks, whereby said at least one hook can be inserted in one of said apertures on said shelf and said binning partitions can then be moved longitudinally to facilitate insertion of said additional similar hook into another of said apertures on said shelf.

22. In combination:

(A) an elongated binning partition having a vertical edge; and (B) a unitary clip secured thereto capable of securely connecting said binning partition at one end thereof at right angles to a banding partition along said vertical edge; said clip comprising a first U-shaped clamp having spaced, substantially parallel arms for gripping therebetween the vertical edge of said binning partition adjacent the banding partition, and a second U-shaped clamp integral with said first U-shaped clamp slidable into engagement with an adjacent top edge of said banding partition; first means on the arms of said first U-shaped clamp for engaging said binning partition; and second means on said binning partition for engagement with said first means, whereby limited upward and downward vertical sliding movement of said clip on said vertical edge of the binning partition is provided, after engagement of the first engaging means on the arms of said first U-shaped clamp with the second engaging means on said binning partition, and horizontal longitudinal movement of said clip on said binning partition is inhibited.

23. The combination of claim 22 wherein said first engagement means comprises at least one inwardly directed projection on at least one of said arms and said second engagement means comprises at least one vertically extending channel adjacent the vertical edge of said binning partition.

24. The combination of claim 22 wherein said first engagement means comprises at least one inwardly directed projection on each of said arms and said second engagement means comprises a pair of opposed vertical channels adjacent the vertical edge of said binning partition.

25. The combination of claim 24 wherein said at least one inwardly directed projection on each of said arms are in facing relationship relative to each other.

26. The combination of claim 22 wherein said first engagement means comprises inwardly directed spaced facing shoulders with an elongated slot therebetween in which the vertical edge of the binning partition slidably fits, with the inner portion of said shoulders defining a vertical groove, and said second engagement means comprises a cooperating laterally extending flange integral with, and extending along, the vertical edge of said binning partition engaging with said vertical groove, with the top edge of said binning partition above said flange having abutment means thereon to limit vertical sliding movement of said clip on said binning partition.

27. The combination of claim 22 wherein said first engagement means comprises at least one vertical slot on at least one of said arms and said second engagement means comprises at least one laterally extending projection on said binning partition extending into said vertical slot.

28. The combination of claim 22 wherein said first engagement means comprises a vertical slot on each of said arms and said second engagement means comprises at least one laterally extending projection on said binning partition extending into an adjacent vertical slot.

29. The combination as defined in claim 28 wherein said vertical slots are vertically aligned with each other.

30. The combination as defined in claim 22 wherein said first engagement means comprises at least one inwardly directed projection on at least one of said arms and said second engagement means comprises at least one vertically extending slot through said binning partition into which said at least one inwardly directed projection extends.

31. The combination as defined in claim 30 wherein said first engagement means comprises a pair of vertically aligned inwardly directed projections.

32. The combination as defined in claim 22 wherein said binning partition has at least one lip projecting longitudinally outward from the lower horizontal edge thereof to support the lower edge of said banding partition thereon.

33. The combination as defined in claim 22 wherein said binning partition has at least one hook projecting downwardly from its lower horizontal edge capable of engaging an aperture on a horizontal surface of a shelf on which said binning partition can be disposed.

34. The combination as defined in claim 33 wherein said at least one hook has an open jaw and is disposed on one portion of said binning partition and at least one additional similar hook having an open jaw is similarly disposed on the remaining portion of said binning partition, with the open jaw of said at least one hook facing the open jaw of said at least one additional similar hook.

35. The combination as defined in claim 34 wherein said binning partition has an elongated vertical slot intermediate said facing hooks, whereby said portions can be moved longitudinally away from each other.

36. The combination as defined in claim 22 wherein said binning partition has at least one lip projecting longitudinally outward from the lower horizontal edge thereof capable of supporting the lower edge of a banding partition thereon, said binning partition has at least one hook having an open jaw projecting downwardly from its lower horizontal edge on one portion thereof and at least one additional similar hook having an open jaw similarly disposed on the remaining portion of said binning partition, with the open jaw of said at least one hook facing the open jaw of said at least one additional similar hook and a vertical slot intermediate said facing hooks, whereby said portions can be moved longitudinally away from each other.

37. A unitary clip, capable of securely connecting an elongated binning partition at a vertical edge thereof at right angles to an elongated banding partition, comprising: a first U-shaped clamp having spaced, substantially parallel arms capable of gripping therebetween the vertical edge of said binning partition adjacent said banding partition, and that is vertically slidable thereon; a second U-shaped clamp integral with said first U-shaped clamp capable of sliding into engagement with the adjacent top edge of said banding partition; first engagement means on said arms of said first U-shaped clamp; said binning partition having second engagement means thereon; and said first engagement means engageable with said second engagement means on said binning partition capable of cooperating therewith for limited upward and downward sliding vertical movement of said clip on said vertical edge of said binning partition, after engagement of the first engaging means on the arms of said first U-shaped clamp with the second engaging means on said binning partition, and for inhibiting longitudinal horizontal movement of said clip on said binning partition.

38. The unitary clip as defined in claim 37 wherein said first engagement means comprises at least one inwardly directed projection on at least one of said arms engageable with said second engagement means on said binning partition comprising at least one vertically extending channel adjacent the vertical edge of said binning partition.

39. The unitary clip as defined in claim 37 wherein said first engagement means comprises at least one inwardly directed projection on each of said arms engageable with said second engagement means on said binning partition comprising a pair of opposed vertical channels adjacent the vertical edge of said binning partition.

40. The unitary clip as defined in claim 39 wherein said at least one inwardly directed projections on each of said arms is in facing relationship relative to each other.

41. The unitary clip as defined in claim 37 wherein said first engagement means comprises inwardly directed, spaced, facing shoulders with an elongated slot therebetween in which the vertical edge of the binning partition slidably fits, with the inner portion of said shoulder defining a vertical groove and said second engagement means comprises a cooperating laterally extending flange integral with, and extending along, the vertical edge of the binning partition.

42. The unitary clip as defined in claim 37 wherein said first engagement means comprises at least one vertical slot on at least one of said arms into which the second engagement means, comprising at least one laterally extending projection on said binning partition, can extend.

43. The unitary clip as defined in claim 42 wherein said first engagement means comprises a vertical slot on each of said arms into which the second engagement means, comprising at least one laterally extending projection on each of said arms of said binning partition, can extend.

44. The unitary clip as defined in claim 43 wherein said vertical slots are aligned vertically with each other.

45. The unitary clip as defined in claim 37 wherein said first engagement means comprises at least one inwardly directed projection on at least one of said arms capable of extending into said second engagement means, which comprises a vertically extending slot through said binning partition.

46. The unitary clip as defined in claim 45 wherein said first engagement means comprises a pair of vertically aligned inwardly directed projections, one of each of said pair on each of said arms.

* * * * *